US005782701A

United States Patent [19]

O'Bryan

[11] Patent Number: 5,782,701

[45] Date of Patent: Jul. 21, 1998

[54] GOLF PRACTICE AID

[76] Inventor: Sean Joseph O'Bryan, Flat 8, 27 Walton Crescent, Abbotsford, NSW 2046, Australia

[21] Appl. No.: 714,151

[22] PCT Filed: Mar. 20, 1995

[86] PCT No.: PCT/AU95/00153

§ 371 Date: Sep. 17, 1996

§ 102(e) Date: Sep. 17, 1996

[87] PCT Pub. No.: WO95/25566

PCT Pub. Date: Sep. 28, 1995

[30] Foreign Application Priority Data

Mar. 21, 1994 [AU] Australia ..... PM4618

[51] Int. Cl.[6] ..... A63B 69/36

[52] U.S. Cl. ..... 473/235; 273/DIG. 30

[58] Field of Search ..... 473/280, 235; 273/DIG. 30, DIG. 8

[56] References Cited

U.S. PATENT DOCUMENTS

| | | | |
|---|---|---|---|
| 1,262,532 | 4/1918 | McElroy | 473/280 |
| 3,032,345 | 5/1962 | Lemelson | 473/280 X |
| 3,185,476 | 5/1965 | Fechner | 273/DIG. 8 |
| 3,401,941 | 9/1968 | Hesidence | 473/235 |
| 3,554,543 | 1/1971 | Di Laura | 273/DIG. 8 |
| 3,721,447 | 3/1973 | Louderbark | 273/DIG. 30 |
| 3,940,145 | 2/1976 | Gentiluomo | 473/280 X |
| 4,718,677 | 1/1988 | Barnes | 273/DIG. 30 |
| 5,213,324 | 5/1993 | Bowers | 473/235 X |

*Primary Examiner*—George J. Marlo
*Attorney, Agent, or Firm*—Cohen, Pontani, Lieberman, Pavane

[57] ABSTRACT

A golf practice aid suitable for use with, and adapted to be struck by a golf club having a strike face. The practice aid including a simulated golf ball with a flexible deformable core surrounded by an energy absorbing outer cover with an adhesive retention means attached thereto. The adhesive retention means in use, releasably adhering to a complementary adhesive retention means attached to the strike face when struck by the club. The arrangement of the core and cover and the properties associated with each are such that the simulated golf ball when struck by the club produces a sound similar to an actual golf ball and absorbs energy imparted to the ball upon impact so as to ensure adherence of the ball to the strike face of the club.

15 Claims, 2 Drawing Sheets

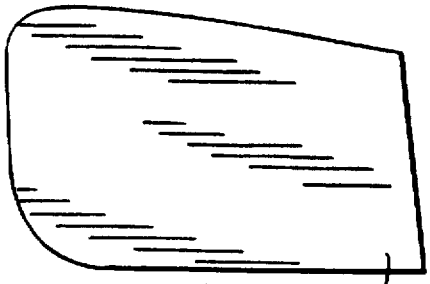
FIG. 1
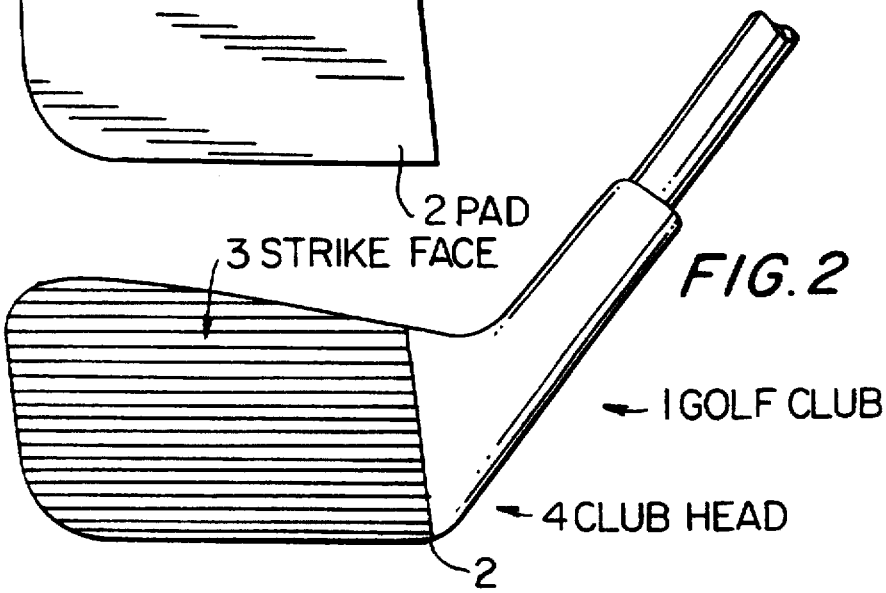
FIG. 2
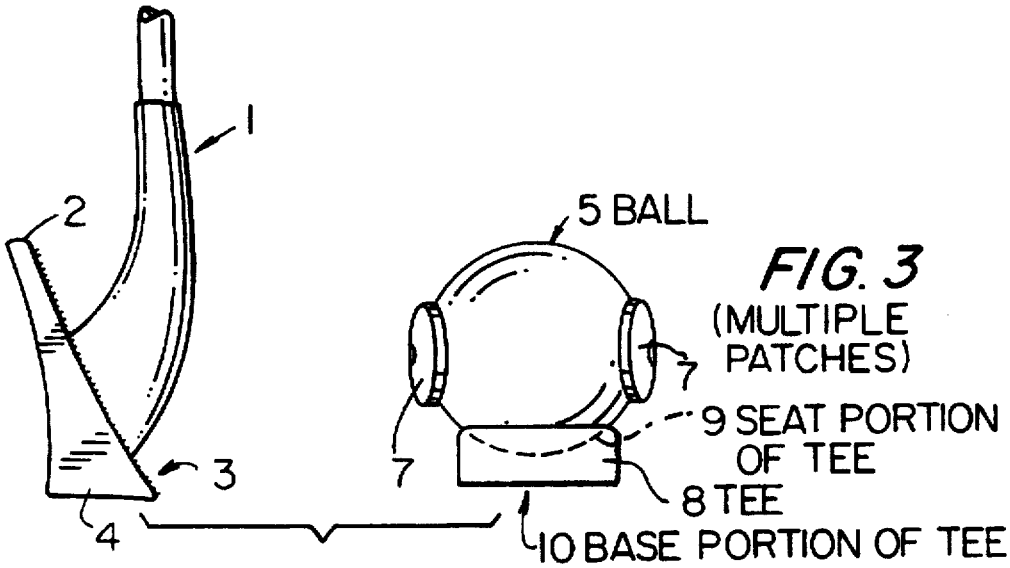
FIG. 3 (MULTIPLE PATCHES)
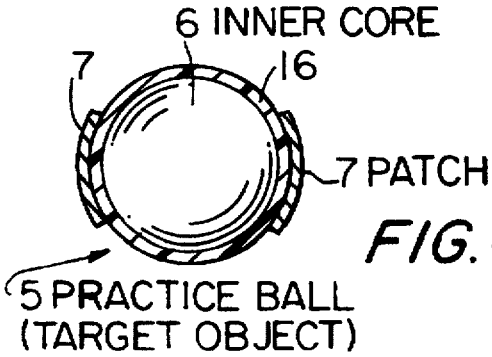
FIG. 4
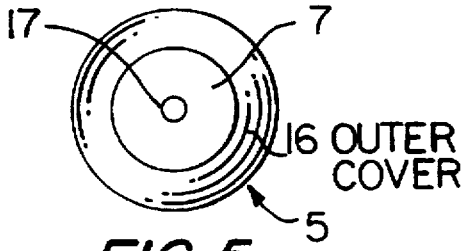
FIG. 5

FIG. 6
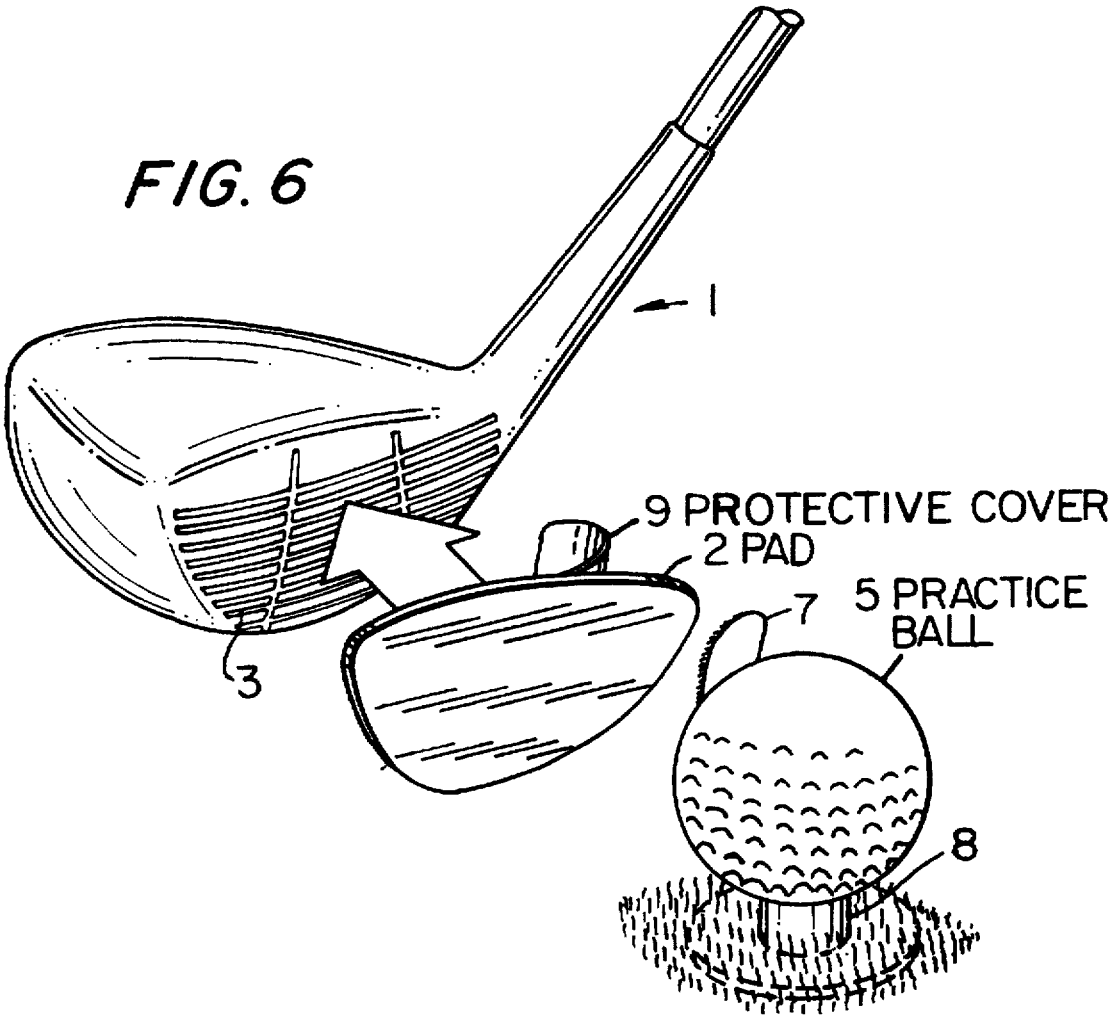
FIG. 7
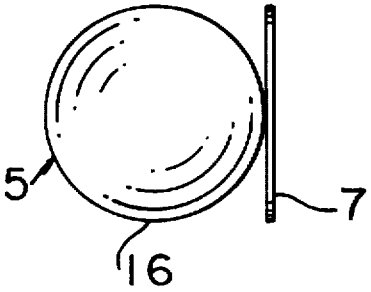
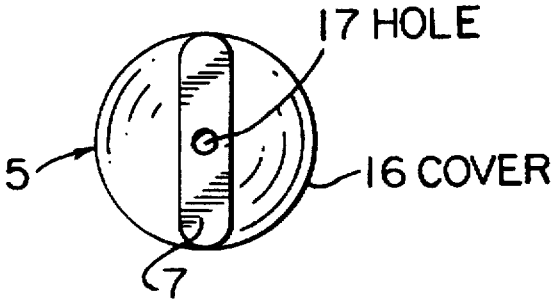
FIG. 8

GOLF PRACTICE AID

BACKGROUND OF THE INVENTION

1. Field of the Invention

This invention relates to golf practice aids and in particular to aids to practice striking a ball.

2. Description of Related Art

Traditionally practice of this kind occurs at driving ranges. These usually comprise a full scale fairway without a green. The golfer places a ball on a tee, addresses the ball, swings a club and strikes the ball to propel it down the fairway. Generally this is repeated several times before the golfer retrieves the balls driven down the practice fairway. This involves travelling a considerable distance down the fairway to locate and retrieve the balls or, as is more usual at commercial ranges, having the balls retrieved by persons employed for the purpose. Ball retrieval is a time-consuming and tiresome or expensive tasks.

Hitherto a variety of training appliances and apparatus have been proposed to aid the golfer in the practice of the kind in question. These range from expensive and technically complex computer and video aided equipment to uncomfortable mechanical hardware into which a golfer is harnessed, and to less expensive and simpler aids such as the use of a ball connected by a flexible cord to an anchor. However the latter aid may be hazardous and requires the use of a sizeable obstruction-free practice zone.

It is also known to practice with lightweight balls in place of standard balls. These are usually the size and shape of standard balls but are constructed of lightweight material. They may be of solid or hollow construction. One known lightweight ball comprises a perforated hollow shell wherein the perforations increase drag when the ball is in flight. The lightweight balls are addressed and struck in the usual manner but the distance they travel is significantly less than that of standard golf balls. Practicing with lightweight balls thereby obviates the need for a fairway-sized practice green. Nevertheless a sizeable obstruction-free practice zone is required and ball retrieval is still a time-consuming and tiresome task.

Another prior art device is described in U.S. Pat. No. 5,121,924. This patent discloses a golf practice device which includes a simulated ball comprising a low mass foam ball having a strip of VELCRO extending around the entire circumference of the foam ball. The VELCRO cooperates with a VELCRO pad or the strike face of the golf club so that when the foam ball is struck by the golf club it adheres to the strike face. This device suffers from several problems. Firstly, the foam ball is likely to be damaged relatively easily because it is exposed when in use. Furthermore, the foam ball will not stick to the club strike face every time. It is believed this may be because the VELCRO strip extends continuously around the circumference of the foam ball and as such is limited in the manner it can be deformed. A further disadvantage with the device is its appearance and its "feel" when the club strikes the ball. The foam ball does not look like a normal golf ball nor does it provide any noise or feeling of impact when the club strikes the ball. This is a particularly important factor if the device is to be used as a golf practice device.

An object of the present invention is therefore to provide a golf practice aid which will substantially overcome or alleviate one or more of the abovementioned disadvantages.

SUMMARY OF THE INVENTION

According to one aspect the invention there is provided a golf practice aid suitable for use with, and adapted to be struck by a golf club having a strike face, the aid comprising a simulated golf ball which includes an inner lightweight core and outer cover having retention means on its surface, the properties of the core and cover being such that the ball is adapted to be releasably retained on the strike face of the golf club after being struck.

Preferably, the retention means on the golf practice aid comprise one part of a coupling means whereby the ball is adapted to be releasably retained when the strike face of the golf club is furnished with a complementary second part of the coupling means.

Preferably, the core is formed from a lightweight compressible material and the cover is formed from a tear-resistant flexible material such that when, in use, the retention means on the outer surface of the ball is released from the face of the golf club, the cover material resists tearing.

Preferably, the outer cover of the ball has at least one hole therein so that when in use, upon impact of the club with the ball the core will readily deform to assist in ensuring that the retention means will retain the ball on the club face. The hole in combination with the materials from which the cover is made tend to absorb the energy during the striking of the club and ball thereby limiting the problem of "bounce" whereby the strike face does not adhere to the ball.

The retention means on the outer cover may be in the form of a VELCRO patch arranged to co-operate with a VELCRO patch on the face of the golf club. The patch on the golf club face may be removably attached so that the golf club may be used in the normal fashion when not practising. In one embodiment the patch on the ball comprises a central region and end regions with the patch secured to the ball in the central region and the two end regions extending generally tangentially to the ball.

The core of the ball may be formed from a plastic material such as polyurethane foam, ethyl vinyl acetate foam, or other resilient material.

In one preferred form the core comprises a polyurethane foam having a density in the range of 35–80 kg/cubic meter and preferably has a hardness in the range of 200–500 newtons.

The outer cover is preferably formed from a latex material having a tensile strength preferably in the range of 22–30 mega pascals a polyurethane elastomer, liquid silicon plastisol or the like. It is also preferable that the modulus of elasticity of the outer cover is in the range of 700 to 950%.

The outer cover of the ball may be dimpled in a similar fashion to a conventional golf ball. In addition, the patch on its outer surface is relatively small compared to the surface of the ball so that the ball looks substantially the same as a conventional golf ball.

According to another aspect of the invention there is provided a golf club having a strike face adapted to strike a lightweight simulated golf ball as described above wherein the strike face has retention means on its surface to enable the target object to be releasably retained on the strike face of the club after being struck thereby.

Preferably, the golf club's retention means comprise in part of a coupling means adapted to releasably retain the target object when the target object is furnished with a complementary second part of said coupling means on its surface.

The invention further consists in a combination of a golf club and a lightweight target object respectively furnished with co-acting parts of coupling means.

It will be apparent from the foregoing that the practice aid of the present invention exhibits many advantages over the prior art devices. The provision of a cover protects the ball from repetitive use. In the preferred form, the cover includes a hole in it which together with the properties of the core and cover ensure that in most instances the ball will adhere to the club strike face when being used. This may be further enhanced when the patch on the ball is fixed thereto only in the central region with the opposed end portions extending tangentially from the ball. Furthermore, when the ball is struck it emits a sound similar to a golf ball when struck by a club. This is believed to be because of the arrangement of the cover, core and hole in the cover which cause the noise effect. In addition, the ball simulates in appearance a normal golf ball and therefore it is not disconcerting to use by a golfer.

BRIEF DESCRIPTION OF THE DRAWINGS

Preferred embodiments of the invention will hereinafter be described with reference to the accompanying drawings.

FIG. 1 is a plan view of one part of a coupling means adapted to be applied to a strike face of a golf club being a component of a combination in accordance with the invention;

FIG. 2 is an elevation view of part of a golf club being a component of a combination in accordance with the invention illustrating the one part of a coupling means of FIG. 1 applied to the strike face of the club;

FIG. 3 is a diagrammatic perspective side view of part of the golf club of FIG. 2 addressing a target object being components of the combination in accordance with the invention;

FIG. 4 is a schematic cross-sectional side view of the target object of FIG. 3;

FIG. 5 is a diagrammatic end view of the target object of FIG. 4.

FIG. 6 is a schematic perspective view of another embodiment;

FIG. 7 is a side view of another form of target object according to the present invention; and FIG. 8 is an end view of the target object shown in FIG. 7.

DETAILED DESCRIPTION OF THE PRESENTLY PREFERRED EMBODIMENTS

Referring to the drawings, a golf club 1 is provided with one part of retention means in the form of an adhesive backed VELCRO pad 2 affixed to the strike face 3 of the club head 4. As shown in FIG. 6 a protective cover 9 may overlie the adhesive. The pad 2 is of a size and shape to cover the entire strike face of the club. Alternatively it may, for example, partly cover same.

The practice ball 5 comprises a lightweight ball-shaped inner core 6 and outer cover 16 of external size and shape comparable to a standard golf ball, provided with a complementary second part of the retention means in the form of a VELCRO patch 7 affixed to the surface thereof. The thickness of the cover is exaggerated for ease of illustration. This patch 7 is adapted to couple to the pad 2 affixed to the club head 4 upon contact therebetween to enable the target object 5 to impinge and be retained on the strike face 3 of the club at the point of impact therebetween. More than one patch may be applied to the target object as shown in FIG. 3. In the embodiment of FIGS. 3, 4 and 5 the patch 7 is of generally circular in shape however, it could be rectangular or any other configuration. In the embodiment of FIGS. 7 and 8 the patch 7 is attached to the ball 5 only in the centre region thereof. Two opposite end portions of the patch extend generally tangentially away from the ball 5. These free end portions being flat rather than following the curvature of the ball tend to alleviate further the problem of "bounce: and can be used with any club face notwithstanding the degree of loft and tend not to be affected by the way the strike face of the golf club strikes the ball. The two end portions tend to compensate for the aforementioned variables. The hole 17 is provided in the cover 16. The hole 17 is shown in the region of the patch 7. It will be appreciated however that the hole could be located anywhere on the cover. The area of contact of the patch in this embodiment should be about 110 to 115 sq mm when the ball is about the size of a normal golf ball.

In other embodiments one or more of the patch 7 or pad 2 may, for example, be backed by resilient impact absorbing material such as rubber, foam plastics or other absorbing material.

The core 6 of the ball 5 may be formed of flexible foam polyurethane, and other flexible deformable material. The cover 16 may be formed of latex, silicon, polyurethane elastomer, plastisol or other high tensile resilient material.

FIG. 3 illustrates the golf club head 4 addressing the ball 5 which has been placed on a tee 8. The illustrated tee 8 comprises a seat portion 9 adapted to support a ball and a base portion 10 adapted to sit on a substantially flat surface. Alternatively the base portion 10 may include projections or barbs.

In use the target ball is positioned on a tee 8 with the patch 7 oriented so that the head of the club may address one of the patches 7. The user then swings the club to strike the ball 5. The pad 2 and patch 7 come together at the point of impingement therebetween and the complementary parts of the retaining means forming the VELCRO pad 2 and patch 7 couple to hold the object to the strike face of the club at the point of impact. The club face with the target object releasably secured thereto may then be inspected to ascertain the correctness of the swing and more particularly the accuracy of the strike. After inspection the user simply uncouples the target object from the club head and prepares for the next stroke.

The illustrated practice aid enables the user to practice striking a target object without propelling same away from the tee area. However this aid is advanced by way of example only, and it is to be understood that various modifications, alterations and additions may be introduced into the constructions and arrangement of parts previously described without departing from the spirit or ambit of the invention. For example, a material other than VELCRO may form the coupling or retention means. It may, for example, take the form or a tacky material on one component and a complementary tacky material on the other. In the illustrated embodiment both components of the combination are modified by applying to each one of complementary parts of a coupling means. In other embodiments the whole of the retention means may be applied to the target object or to the club.

Finally, it is to be understood that the inventive concept in any of its aspects can be incorporated in many different constructions so that the generality of the preceding description is not to be superceded by the particularity of the attached drawings. Various alterations, modifications and/or additions may be incorporated into the various constructions and arrangements of parts without departing from the spirit or ambit of the invention.

I claim:

1. A golf practice aid suitable for use with, an adapted to be struck by a golf club having a strike face, the aid comprising a simulated golf ball which includes a flexible deformable core surrounded by an energy absorbing outer cover with an adhesive retention means attached to an outer surface of said cover, said adhesive retention means releasably adhering to a complementary adhesive retention means attached to the strike face when struck by said club, wherein said cover comprises a material having a predetermined tensile strength and said core comprises a material having a predetermined density such that when struck said simulated golf ball adheres to the strike face and produces a sound of an actual golf ball being struck by a golf club.

2. The golf practice aid in accordance with claim 1, wherein said cover is formed from a tear-resistant flexible material so that, in use, said cover resists tearing when said adhesive retention means on said cover is separated from said complementary adhesive retention means on the strike face of said golf club.

3. The golf practice aid in accordance with claim 1, wherein said adhesive retention means on said cover and said complementary adhesive retention means on the strike face of said club comprise complementary hook-and-loop type material.

4. The golf practice aid in accordance with claim 1, wherein said core material is a flexible deformable polyurethane foam plastic.

5. The golf practice aid in accordance with claim 4, wherein said core material has a density between approximately 35 $kg/m^3$ and approximately 80 $kg/m^3$.

6. The golf practice aid in accordance with claim 5, wherein said core material has a hardness between approximately 200 newtons and approximately 500 newtons.

7. The golf practice aid in accordance with claim 1, wherein said cover material is one of a polyurethane elastomer, liquid silicon and plastisol, having a tensile strength between approximately 22 MPa and approximately 30 MPa.

8. The golf practice aid in accordance with claim 7, wherein said cover material has a modulus of elasticity between approximately 700% and approximately 950%.

9. The golf practice aid in accordance with claim 1, wherein said adhesive retention means on said cover comprises a patch with a smaller surface area than the entire area of said outer surface of said cover.

10. The golf practice aid in accordance with claim 1, wherein said adhesive retention means on said cover comprises a patch having a central region and two opposed end regions, wherein said patch is tangentially mounted to said cover at the central region so that the end regions extend away from said cover.

11. In combination a golf club having a strike face adapted to strike a lightweight simulated golf aid according to claim 1 hereof wherein said strike face has adhesive retention means on its surface to enable the aid object to be releasably retained on the strike face of the club after being struck thereby.

12. A golf practice aid suitable for use with, and adapted to be struck by a golf club having a strike face, the aid comprising a simulated golf ball which includes a flexible deformable core surrounded by an energy absorbing outer cover having a hole defined therein so that, in use, upon impact of said club with said simulated golf ball said core and cover readily deform to ensure that said ball is retained on the strike face of said club, and an adhesive retention means attached to an outer surface of said cover, said adhesive retention means releasably adhering to a complementary adhesive retention means attached to the strike face when struck by said club, wherein said cover comprises a material having a predetermined tensile strength and said core comprises a material having a predetermined density such that when struck said simulated golf ball adheres to the strike face and produces a sound of an actual golf ball being struck by a golf club.

13. The golf practice aid in accordance with claim 12, wherein said adhesive retention means on said cover and said complementary adhesive retention means on the strike face of said club comprise complementary hook-and-loop type material.

14. The golf practice aid in accordance with claim 13, wherein said adhesive retention means on said cover comprises a patch with a smaller surface area than the entire area of said outer surface of said cover.

15. The golf practice aid in accordance with claim 14, wherein said patch on said cover includes a central region and two opposed end regions, wherein said patch is tangentially mounted to said cover at the central region so that the end regions extend away from said cover.

* * * * *